US006576114B1

(12) United States Patent
Gioria

(10) Patent No.: US 6,576,114 B1
(45) Date of Patent: Jun. 10, 2003

(54) ELECTROPLATING COMPOSITION BATH

(75) Inventor: Jean-Michel Gioria, Geneva (CH)

(73) Assignee: Enthone Inc., West Haven, CT (US)

( * ) Notice: Subject to any disclaimer, the term of this patent is extended or adjusted under 35 U.S.C. 154(b) by 481 days.

(21) Appl. No.: 09/069,442

(22) Filed: Apr. 29, 1998

Related U.S. Application Data

(63) Continuation of application No. PCT/GB96/02652, filed on Oct. 31, 1996.

(30) Foreign Application Priority Data

Nov. 3, 1995 (GB) ..... 9522591
Nov. 9, 1995 (GB) ..... 9522997

(51) Int. Cl.[7] ..... C25D 3/62

(52) U.S. Cl. ..... 205/250; 205/267; 205/266; 205/247; 106/1.13; 106/1.18; 106/1.26

(58) Field of Search ..... 205/50, 242, 247, 205/248, 250, 267, 268, 266; 428/469; 106/1.13, 1.18, 1.26

(56) References Cited

U.S. PATENT DOCUMENTS

| | | | | |
|---|---|---|---|---|
| 2,724,687 A | | 11/1955 | Spreter et al. | |
| 3,380,814 A | | 4/1968 | Cathrein et al. | |
| 3,904,493 A | | 9/1975 | Losi et al. | |
| 3,926,748 A | | 12/1975 | Lerner | |
| 3,929,595 A | | 12/1975 | Biberbach et al. | |
| 4,012,294 A | | 3/1977 | Losi et al. | |
| 4,075,065 A | | 2/1978 | Korbelak et al. | |
| 4,358,351 A | | 11/1982 | Simon et al. | |
| 4,374,006 A | | 2/1983 | Bitzer et al. | |
| 4,470,886 A | | 9/1984 | Duva et al. | |
| 4,687,557 A | * | 8/1987 | Emmenegger | 205/50 |
| 5,169,514 A | * | 12/1992 | Hendriks et al. | 205/247 |
| 5,552,031 A | * | 9/1996 | Moon | 205/247 |

FOREIGN PATENT DOCUMENTS

| | | |
|---|---|---|
| DE | 2340462 A | 2/1978 |
| EP | 140832 | 5/1985 |
| EP | 480876 | 4/1992 |
| GB | 1279141 A | 6/1972 |
| GB | 1375611 A | 11/1974 |
| GB | 1445395 A | 8/1976 |
| GB | 1 447 058 | 8/1976 |
| GB | 2151661 A | 7/1985 |
| JP | 51056241 A | 5/1976 |
| JP | 52058023 A | 5/1977 |
| JP | 56105494 | 8/1981 |
| JP | 56136994 | 10/1981 |
| JP | 57120685 | 7/1982 |
| JP | 57120686 | 7/1982 |
| JP | 7018484 | 1/1995 |

* cited by examiner

*Primary Examiner*—Roy King
*Assistant Examiner*—Wesley A. Nicolas
(74) *Attorney, Agent, or Firm*—Senniger, Powers, Leavitt & Roedel

(57) ABSTRACT

There is provided an electrodeposit free of cobalt, cadmium and nickel which contains 1.25 to 1.55% w/w iron, 1 to 2 ppm zirconium; and 97.7 to 98.2% gold and has a pale yellow color less than 3N on the NIHS scale. The invention also provides an electroplating bath, free of cobalt, cadmium and nickel comprising gold, as cyanide, iron as a soluble salt or complex, a soluble zirconium salt or complex, a citrate, a weak acid, and optionally a heterocyclic sulphonate, which in a preferred form comprises gold as cyanide in an amount of 2.5 to 3.5 g/l gold, iron as iron nitrate in an amount of 0.6 to 0.8 g/l, zirconium as zirconium nitrate in an amount of 0.2 to 0.5 g/l, diammonium hydrogen citrate in an amount of 75 to 125 g/l, citric acid in an amount of 40 to 80 g/l, and 3-(1-pyridino)-1-propane sulphonate in an amount of 1 to 3 g/l.

2 Claims, No Drawings

ELECTROPLATING COMPOSITION BATH

This is a continuation of International Application No. PCT/GB96/02652, filed Oct. 31, 1996.

The present invention relates to gold-iron alloy electroplating processes, compositions for use therein and gold-iron alloy electrodeposits produced therefrom.

Gold alloy electrodeposits are extensively used for decorative and functional deposits. Gold alloys with copper, cadmium, cobalt, indium, zinc or tin or mixtures thereof are well known. Examples of patent literature giving details of such compositions revealed by searches by the applicants are JP 53-58023 (Matsushita), JP 51-56241 (Citizen Watch), DE 1696087 (OMF), U.S. Pat. No. 3,926,748 (AMP), GB 1445395 (Schering), GB 1375611 (Lea-Ronal), GB 1279141 (Degussa), GB 2151661 (LPW-Chemie), EP 193848 (Emmenegger), U.S. Pat. No. 4,470,886 (OMI), U.S. Pat. No. 2,724,687 (Spreter), JP 57-120686 (Suwa Seikosha), JP 57-120685 (Suwa Seikosha), JP 56-136994 (Nippon Mining), JP 56-105494 (Nippon Mining) and EP 140832 (H.E. Finishing).

An article in *Galvanotechnik* vol 83 (1992) pp 808–817 and 1180–1184 by F. Simon mentions gold-iron electroplating using cyanide baths. It refers to gold cyanide complex baths containing cobalt, nickel, indium, iron (it is not clear whether these are present together or separately) in a weak acid bath at pH 3–6.

A search by the UK Patent Office revealed the following cases: GB2242200 (Enthone); GB 1426849 (Deutsche Gold und Silber); EP-A-0480876 (Metaux Precieux); EP-A-0037534 (Degussa); U.S. Pat. No. 4,687,557 (Emmenegger); U.S. Pat. No. 4,358,351 (Degussa); JP-7018484 (Seiko); and U.S. Pat. No. 4,075,065 (Handy & Harman).

Gold-iron baths have the advantage of not inducing allergic reactions in contact with skin such as can be caused by gold alloys containing nickel or cobalt, and do not contain cadmium which is a toxic metal.

It is very desirable to use gold alloy electrodeposits which do not contain nickel or cobalt for skin contacting products, such as rings and spectacle frames.

Gold-iron alloy electrodeposits however are thought to be brittle and to be liable to crack damaging the corrosion resistance of the product. In addition they tend to be too warm a yellow for decorative uses and a paler colour is desired. Colour for gold alloy electrodeposits can be assessed on the (NIHS 03–50) standards scale. NIHS is Normes de l'industrie horlogere Suisse or Swiss watch industry standards. This provides a colour scale ranging from 5N (red), via 4N (pink) to 3N, which is the too warm yellow colour of conventional gold-iron alloy electrodeposits, 2N-18 to 1N 14. The colours are made from gold-silver-copper alloys containing the following amounts for the relevant colours.

| Colour | 5N | 4N | 3N | 2N-18 | 1N-14 |
|---|---|---|---|---|---|
| Ingredient | | | | | |
| gold | 750 | 750 | 750 | 750 | 585 |
| silver | 45 | 90 | 125 | 100 | 265 |
| copper | 205 | 100 | 125 | 90 | 150 |

The NIHS 03-50 standard states that for gold articles the colour 1N-14 is not obtainable for an alloy of more than 14 carats and for the colour 2N-18 for an alloy of more than 18 carats.

It is desired to produce a gold-iron alloy electrodeposit which has a colour of preferably 2N-18 to 1N-14 on the NIHS scale and which is free of cobalt, cadmium and nickel, and which has good corrosion resistance.

The applicants conducted extensive research to modify the colour of conventional gold-iron alloy deposits. These deposits contain 2.1% iron, 97.9% gold and have a colour of 3N(+).

Addition of zinc sulphate at from 50–200 mg/l gave a colour of 3N to 3N(+); at 300 mg/l the colour becomes too yellow-gray.

Addition of ammonium monovanadate at from 100 mg/l to 1500 mg/l only gave a colour of 3N.

Addition of cadmium acetate on its own or with diethylene triamine penta-acetic acid (DTPA) chelate only gave a colour of 3N.

Lead acted as a metallic impurity, only brown and matt deposits being produced.

Addition of vanadium (IV) oxidesulphate in amounts up to 150 mg/l only gave a colour of 3N to 3N(+).

Addition of ammonium bismuth citrate with DTPA only gave a colour of 3N to 3N(+).

Addition of sodium tungstate dihydrate at from 0.55 to 4.45 g/l of tungsten at current densities of 1 to 4 A/dm$^2$ and at pH values from 3.5 to 4.45 only gave a colour of 3N.

Addition of 5 g/l of nicotinic acid allowed one to increase the current density to 4 A/dm$^2$ without burnt deposits but the colour remained at 3N(+).

Bismuth and lead both acted as a metallic impurity and only brown and matt deposits were produced. Lead was added as lead nitrate. Bismuth was added as bismuth III nitrate pentahydrate.

Addition of potassium stannate 1 g/l at current densities of 1 to 3 A/dm$^2$ only gave a colour of 3N(+).

Addition of cerium (III) nitrate hexahydrate at 1 g/l gave a colour of between 3N and 2N-18. Cerium (III) sulphate, cesium nitrate and cesium sulphate all had no effect on the colour of the deposit.

The applicants then tried addition of zirconium sulphate at 1 g/l at a current density of 1 A/dm$^2$ at 32° C. and a pH of 3.14. This gave a deposit with a colour near 2N-18 but very slightly more grey.

EP-A-0193848 is concerned with gold-copper-cadmium-zinc cyanide baths and refers to a number of inorganic brighteners. Baths B1 to B5 show the use of selenium as sodium selenite, arsenic as sodium arsenite and zirconium as the sodium zirconium hydroxy ethyl-imino-diacetate, as inorganic brighteners in B2-B5, no brighteners being used in B1.

Col. 13 l. 38–42 of EP-A-0193848 states that all these deposits are pale yellow and give a colour of approximately 1N-14. There is no teaching of any effect on colour produced by the presence of zirconium. Bath B2 contains zirconium as the inorganic brightener, bath B1 does not contain an inorganic brightener.

In addition it is extremely difficult to obtain a constant colour in the range 1N-14 to 2N-18 with gold-copper-cadmium or gold-copper-cadmium-zinc systems.

According to the present invention an electrodeposit is provided which contains about 1.25 to 1.55% w/w iron, about 1 to 2 ppm zirconium; and about 97.7 to 98.2% gold and has a pale yellow colour less yellow than 3N on the NIHS scale, and preferably at or near 2N-18.

It will be recognised that such a deposit is also of high carat. It is preferred that the deposit be of about 23–23.6 carat.

The gold-iron-zirconium deposits of the present invention are free of toxic and allergy causing ingredients, have high carat values and corrosion resistance and at the same time a desirable pale yellow colour.

The invention also extends to an electroplating bath, free of cobalt, cadmium or nickel comprising gold, as cyanide, iron as a soluble salt or complex, a soluble zirconium salt or complex, a citrate, a weak acid, and optionally a heterocyclic sulphonate such as PPS. The function of the PPS is to allow higher cathodic current densities and to improve the macrodistribution a little.

The gold is preferably present as gold potassium cyanide preferably in an amount of about 1.0 to 10 g/l especially about 2.5 to 3.5 g/l of gold.

The iron is preferably present as a nitrate which may be hydrated. It is preferably present in an amount up to 5 g/l of iron e.g., about 0.1 to 5 g/l preferably about 0.2 to 3 g/l especially about 0.6 to 0.8 g/l. Different contents of iron in the plating bath do not affect the colour of the deposit significantly, but the more iron there is in the bath the more there is in the deposit. However at a current density of about 0.5 A/dm$^2$ as the iron content of the bath increases from about 0.25 g/l, at which the cathodic efficiency is 25 mg/A.min, to 2.0 g/l the cathodic efficiency falls to 7 mg/A.min.

Examples of other salts which may be used instead of iron nitrate are iron sulphate, iron (III) chloride, iron (III) citrate and iron (III) phosphate.

The zirconium is preferably present as the nitrate, which may be hydrated, or less conveniently as the sulphate or as ammonium zirconium citrate complex. The zirconium is preferably present in an amount of about 0.01 to 2 g/l of zirconium e.g. about 0.04 to 1.5 g/l or about 0.1 to 1 g/l, especially about 0.2 to 0.5 g/l.

The citrate is preferably diammonium hydrogen citrate ($C_6H_{14}N_2O_7$) or $(NH_4)_2C_6H_6O_7$ and is preferably present in an amount of about 10 to 500 g/l e.g. about 50 to 200 g/l especially about 75 to 125 g/l. Diammonium hydrogen citrate is preferred to sodium or potassium citrate because it gives much higher macrodistribution of the gold layer e.g. as high as 90% as shown by tests in a Haring cell, as compared with about 50% when sodium or potassium citrate is used.

The weak acid is preferably a hydroxy carboxylic acid such as citric acid ($HO(COOH)(CH_2COOH)_2.H_2O$, though other carboxylic acids such as oxalic, lactic, formic, thiomalic, gluconic, tartaric, acetic or malic acid could be used. Phosphoric acid could also be used instead of citric acid.

The weak acid is preferably present in an amount of about 1 to 500 g/l e.g. about 10 to 200 g/l e.g. about 20 to 100 g/l especially about 40 to 80 g/l.

The PPS is 3-(1-pyridino)-1-propane sulphonate ($C_8H_{11}NO_3S$). It is preferably present in an amount of about 0.1 to 10 g/l e.g., about 0.5 to 5 g/l especially about 1 to 3 g/l.

Materials which can be used instead of PPS include for example pyridine-4-ethanesulphonic acid.

The bath can be used to plate gold-iron-zirconium deposits directly on a range of substrates such as nickel undercoat, or one of the following when provided with a flash of pure gold, namely copper, palladium, palladium-nickel, palladium-cobalt, gold-silver or gold-copper-cadmium.

The invention can be put into practice in various ways and a number of specific embodiments will be described to illustrate the invention with reference to the accompanying examples.

EXAMPLE 1A, 1B and 1C

Examples 1A and 1B are comparison examples of a gold-iron acid plating bath which does not contain zirconium; Example 1C is in accordance with the invention. Details are given in Table 1 below.

TABLE 1

| Example | 1A | 1B | 1C |
|---|---|---|---|
| Ingredient | | | |
| Gold g/l | 3 | 3 | 4 |
| as gold potassium cyanide (1) | 4.39 | 4.39 | 5.85 |
| Iron g/l | 0.72 | 0.72 | 0.72 |
| as iron (III) nitrate nonahydrate | 5.2 | 5.2 | 5.2 |
| Additional metal g/l | | | |
| zirconium | | | |
| as zirconyl silicate ($ZrSiO_4$) | — | — | <0.5 |
| as zirconyl nitrate hydrate | — | — | — |
| Citrate g/l | | | |
| diammonium hydrogen citrate | — | — | — |
| sodium citrate dihydrate | 40 | 40 | 49 |
| potassium citrate | | | |
| Weak Acid g/l | | | |
| citric acid | 60 | 60 | 60 |
| Additive g/l | | | |
| PPS (2) | — | — | — |
| Bath properties | | | |
| pH | 3.5 | 3.5 | 3.5 |
| density ° Be (Baume) | 8 | 8 | 8 |
| Plating conditions | | | |
| Temperature ° C. | 32 | 32 | 32 |
| rack/barrel (3) | R | R | R |
| current density A/dm$^2$ | 1 | 0.5 | 2 |
| plating time min | 9 | 21 | 6 |
| number of A/litre | 0.2 | 0.2 | 0.4 |
| anode - cathode ratio | 4/1 | 4/1 | 4/1 |
| agitation solution (4) | 4A | 4A | 4A |
| agitation cathode (5) | 7 | 7 | 7 |
| cathode (6) | brass | brass | brass |
| anode (7) | PT | PT | PT |
| Plating performance | | | |
| efficiency mg/A.min | 19.5 | 16.2 | 14 |
| plating rate mins/ micrometer thickness of deposit | 9 | 21 | 6 |
| macrodistribution % (8) | — | — | 38 |
| Deposit characteristics | | | |
| colour (NIHS) | 3N+ | 3N | 2N-18 |
| thickness | 1.0 | 1.0 | 1.0 |
| Carat | 23.5 | 23.5 | — |
| hardness (Knoop) | 140 | 140 | — |

Notes on Table 1
(1) Gold potassium cyanide is $KAu(CN)_2$
(3) Rack plating is signified by R, barrel plating by B.
(2) PPS is 3-(1-pyridino)-1-propane-sulphonate ($C_8H_{11}NO_3S$).
(4) Agitation of the solution by vigorous stirring with a magnetic stirrer is signified by 4A.
(5) Agitation of the cathode by revolution of the cathode is given by the number of rpm of the cathode e.g. 7.
(6) The cathode is brass.
(7) The anode is platinized titanium.
(8) The term macrodistribution is concerned with the extent to which different samples on different parts of a plating jig or rack are coated to the same thickness using a current density of 1 A/dm$^2$.

The Haring cell gives an indication of the macrodistribution. If the % value obtained is low (20–30% in this case) this means that there will be a large range of different deposit thicknesses for the different articles being plated. If the value is 80–90% this means that the deposit thickness on the articles will be more or less the same wherever they are on the jig.

The Haring cell consists of a rectangular plating cell having opposed end walls affording cathodes and a planar anode placed between them parallel to the cathode and dividing the cell unequally. The extent to which the cathodes are plated the same amount is assessed as the macrodistribution. If they are equally plated the macrodistribution is 100%.

Example 1C demonstrates that even a relatively insoluble zirconium salt can be used as a vehicle for introducing zirconium into the system. However more soluble salts are easier to work with and are preferred.

EXAMPLE 2

This is in accordance with the present invention, details are given in Table 2 and give results at different current densities.

Examples 2B and 2E are comparative examples. It will be noted that in Example 2B the current density is 1 A/dm$^2$ and the colour is 3N. In Example 2E the current density is 5 A/dm$^2$ and the plating efficiency is 11.1 mg/A.min.

TABLE 2

| Example | 2A | 2B | 2C | 2D | 2E | 2F |
|---|---|---|---|---|---|---|
| Ingredient | | | | | | |
| Gold g/l | 3.0 | 3.0 | 3.0 | 3.0 | 3.0 | 2.0 |
| as gold potassium cyanide | 4.39 | 4.39 | 4.39 | 4.39 | 4.39 | 2.92 |
| Iron g/l | 0.72 | 0.72 | 0.72 | 0.72 | 0.72 | 0.72 |
| as iron (III) nitrate nonahydrate | 5.2 | 5.2 | 5.2 | 5.2 | 5.2 | 5.2 |
| Additional metal g/l | | | | | | |
| zirconium | 0.27 | 0.27 | 0.27 | 0.27 | 0.27 | 0.27 |
| as zirconyl silicate ($ZrSiO_4$) | — | — | — | — | — | — |
| as zirconyl nitrate hydrate | 1.0 | 1.0 | 1.0 | 1.0 | 1.0 | 1.0 |
| Citrate g/l | | | | | | |
| diammonium hydrogen citrate | 100 | 100 | 100 | 100 | 100 | 100 |
| sodium citrate | — | — | — | — | — | — |
| potassium citrate | — | — | — | — | — | — |
| Weak Acid g/l | | | | | | |
| citric acid | 60 | 60 | 60 | 60 | 60 | 60 |
| Additive g/l | | | | | | |
| PPS | 2 | 2 | 2 | 2 | 2 | 2 |
| Bath properties | | | | | | |
| pH | 3.4 | 3.4 | 3.4 | 3.4 | 3.4 | 3.4 |
| density ° Be (Baume) | 9 | 9 | 9 | 9 | 9 | 9 |
| Plating conditions | | | | | | |
| Temperature ° C. | 40 | 40 | 40 | 40 | 40 | 40 |
| rack/barrel (3) | R | R | R | R | R | R |
| current density A/dm$^2$ | 2 | 1 | 3 | 4 | 5 | 2 |
| plating time min | 4'10" | 6'10" | 3'15" | 3'13" | 3'13" | 5'20" |
| number of A/litre | 0.4 | 0.2 | 0.6 | 0.8 | 1.0 | 0.4 |
| anode - cathode ratio | 4/1 | 4/1 | 4/1 | 4/1 | 4/1 | 4/1 |
| agitation solution (4) | 4A | 4A | 4A | 4A | 4A | 4A |
| agitation cathode (5) | 7 | 7 | 7 | 7 | 7 | 7 |
| cathode (6) | brass | brass | brass | brass | brass | brass |
| anode (7) | PT | PT | PT | PT | PT | PT |
| Plating performance | | | | | | |
| efficiency mg/A.min | 21 | 29.0 | 18.2 | 12.6 | 11.1 | 16.8 |
| plating rate mins/micrometer thickness of deposit | 4'10" | 6'10" | 3'15" | 3'13" | 3'13" | 5'20" |
| macrodistribution % (8B) (at 2A/dm$^2$) | 90 | 59 | — | — | — | — |
| Deposit characteristics | | | | | | |
| colour (NIHS) | 2N-18+/3N | 3N | 2N-18+ | 2N-18+ | — | 2N-18+/3N |
| thickness | — | — | — | | | |

TABLE 2-continued

| Example | 2A | 2B | 2C | 2D | 2E | 2F |
|---|---|---|---|---|---|---|
| Carat | 23.5 | 23.5 | 23.5 | 23.5 | 23.5 | 23.5 |
| hardness (Knoop) | — | — | — | — | — | — |
| % iron | 1.25 | — | — | — | — | 1.25 |

Notes on Table 2
The anode/cathode ratio, solution agitation (4), cathode agitation (5), cathode material (6) and anode material (7) were as in Table 1.
(8B) The current density used for testing macrodistribution in Examples 2A to 2F was 2 A/dm$^2$.

Heating a brass panel carrying the gold-iron-zirconium deposit (98.7% Au, 1.25% Fe, 2 ppm Zr) of Example 2A of the present invention for 2 hours at 200° C. produced no detectable change in appearance, neither discolouration nor change in colour, and no cracking.

EXAMPLE 3

Details are given in Table 3.

TABLE 3

| Example | 3A | 3B | 3C | 3D | 3E |
|---|---|---|---|---|---|
| Ingredient | | | | | |
| Gold g/l | 4.0 | 4.0 | 4.0 | 4.0 | 4.0 |
| as gold potassium cyanide | 5.85 | 5.85 | 5.85 | 5.85 | 5.85 |
| Iron g/l | 0.72 | 0.72 | 0.72 | 0.72 | 0.72 |
| as iron (III) nitrate nonahydrate | 5.2 | 5.2 | 5.2 | 5.2 | 5.2 |
| Additional metal g/l | | | | | |
| zirconium | | | | | |
| as zirconyl silicate ($ZrSiO_4$) | — | — | | | |
| as zirconyl nitrate hydrate | 0.2 | 1.0 | 0.2 | 0.2 | 0.2 |
| Citrate g/l | | | | | |
| diammonium hydrogen citrate | — | — | | | |
| sodium citrate | 48.75 | 48.75 | 48.75 | 48.75 | 48.75 |
| potassium citrate | — | — | | | |
| Weak Acid g/l | | | | | |
| citric acid | 60 | 60 | 60 | 60 | 60 |
| Additive g/l | | | | | |
| PPS | — | — | — | — | — |
| Bath properties | | | | | |
| pH | 3.4 | 3.4 | 3.4 | 3.4 | 3.4 |
| density ° Be (Baume) | — | — | — | — | — |
| Plating conditions | | | | | |
| Temperature ° C. | 32 | 32 | 31 | 31 | 31 |
| rack/barrel (3) | R | R | R | R | R |
| current density A/dm$^2$ | 2 | 2 | 0.5 | 1 | 2 |
| plating time min | 4'35" | 4'35" | 22' | 9'50" | 4'35" |
| number of A/litre | 0.4 | 0.4 | 0.1 | 0.2 | 0.4 |
| anode - cathode ratio | 4/1 | 4/1 | 4/1 | 4/1 | 4/1 |
| agitation solution (4) | 4A | 4A | 4A | 4A | 4A |
| agitation cathode (5) | 7 | 7 | 7 | 7 | 7 |
| cathode (6) | brass | brass | brass | brass | brass |
| anode (7) | PT | PT | PT | PT | PT |
| Plating performance | | | | | |
| efficiency mg/A.min | 19.10 | 19.10 | 15.7 | 17.9 | 19.1 |
| plating rate mins/micrometer thickness of deposit | 4'35" | 4'35" | 22' | 9'50" | 4'35" |
| macrodistribution % (8) | 38.5 | — | 38.5 | 38.5 | 38.5 |
| Deposit characteristics | | | | | |
| colour (NIHS) | 2N-18(+) | 2N-18(+) | 2N18+ | 2N18+ | 2N18+ |
| thickness | — | — | — | — | — |

TABLE 3-continued

| Example | 3A | 3B | 3C | 3D | 3E |
|---|---|---|---|---|---|
| Carat | — | — | — | — | — |
| hardness (Knoop) | — | — | — | — | — |

Notes on Table 3
The anode/cathode ratio, solution agitation (4), cathode agitation (5), cathode material (6) and anode material (7) were as in Table 1.

EXAMPLE 4

In these examples the effects of varying the additive and the citrate was tested. Details are given in Table 4. The tests were done in a Haring cell.

In addition the tests were done on 7 nickel plated rings and 8 palladium plated rings which were rack plated.

TABLE 4

| Example | 4A | 4B | 4C | 4D |
|---|---|---|---|---|
| Ingredient | | | | |
| Gold g/l | 4 | 4 | 4 | 4 |
| as gold potassium cyanide | 5.85 | 5.85 | 5.85 | 5.85 |
| Iron g/l | 0.72 | 0.72 | 0.72 | 0.72 |
| as iron (III) nitrate nonahydrate | 5.2 | 5.2 | 5.2 | 5.2 |
| Additional metal g/l | | | | |
| zirconium | 0.054 | 0.054 | | |
| as zirconyl silicate ($ZrSiO_4$) | — | — | — | — |
| as zirconyl nitrate hydrate | 0.2 | 0.2 | 0.2 | 0.2 |
| Citrate g/l | | | | |
| diammonium hydrogen citrate | — | — | — | 100 |
| sodium citrate | 48.75 | 48.75 | 48.75 | 48.75 |
| potassium citrate | — | — | — | — |
| Weak Acid g/l | | | | |
| citric acid | 60 | 60 | 60 | 60 |

TABLE 4-continued

| Example | 4A | 4B | 4C | 4D |
|---|---|---|---|---|
| Additive g/l | | | | |
| PPS | — | 2 | 2 | 2 |
| nicotinic acid | — | — | 5 | 5 |
| Bath properties | | | | |
| pH | 3.4 | 3.4 | 3.4 | 3.9 |
| density ° Be (Baume) | — | — | — | — |
| Plating conditions | | | | |
| Temperature ° C. | 31 | 31 | 31 | 31 |
| rack/barrel (3) | R | R | R | R |
| current density A/dm$^2$ | 1 | 1 | 1 | 1 |
| plating time min | 10 | 10 | 10 | 10 |
| number of A/litre | 2.85 | 2.85 | 0.285 | 0.285 |
| anode - cathode ratio | 3/1 | 3/1 | 3/1 | 3/1 |
| agitation solution (4) | 4A | 4A | 4A | 4A |
| agitation cathode (5) | 0 | 0 | 0 | 0 |
| cathode (6) | brass | brass | brass | brass |
| anode (7) | PT | PT | PT | PT |
| Plating performance | | | | |
| efficiency mg/A.min | 19.6 | 20.6 | 9.8 | 14.7 |
| plating rate mins/micrometer thickness of deposit | — | — | | |
| macrodistribution % (8) | 38.6 | 34.5 | 52.2 | 82.2 |

EXAMPLE 5A to 5F

Examples A to F were carried out in a Haring cell. Details are given in Table 5.

TABLE 5

| Example | 5A | 5B | 5C | 5D | 5E | 5F |
|---|---|---|---|---|---|---|
| Ingredient | | | | | | |
| Gold g/l | 4 | 4 | 4 | 4 | 4 | 3 |
| as gold potassium cyanide | 5.85 | 5.85 | 5.85 | 5.85 | 5.85 | 4.39 |
| Iron g/l | 0.72 | 0.72 | 0.72 | 0.72 | 0.72 | 0.72 |
| as iron (III) nitrate nonahydrate | 5.2 | 5.2 | 5.2 | 5.2 | 5.2 | 5.2 |
| Additional metal g/l | | | | | | |
| zirconium | 0.081 | 0.081 | 0.081 | 0.081 | 0.081 | 0.27 |
| as zirconyl silicate ($ZrSiO_4$) | — | — | — | — | — | — |
| as zirconyl nitrate hydrate | 0.3 | 0.3 | 0.3 | 0.3 | 0.3 | 1 |
| Citrate g/l | | | | | | |
| diammonium hydrogen citrate | 70 | 100 | 100 | 100 | 100 | 100 |

TABLE 5-continued

| Example | 5A | 5B | 5C | 5D | 5E | 5F |
|---|---|---|---|---|---|---|
| sodium citrate | — | — | — | — | — | — |
| potassium citrate | — | — | — | — | — | — |
| Weak Acid g/l | | | | | | |
| citric acid | 60 | 60 | 60 | 60 | 60 | 60 |
| Additive g/l | | | | | | |
| PPS | — | — | 2 | 2 | 2 | 2 |
| nicotinic acid | — | — | — | — | — | — |
| Bath properties | | | | | | |
| pH | 3.24 | 3.39 | 3.39 | 3.5 | 3.5 | 3.5 |
| density ° Be (Baume) | — | — | — | — | — | — |
| Plating conditions | | | | | | |
| Temperature ° C. | 30 | 30 | 30 | 40 | 40 | 40 |
| rack/barrel (3) | R | R | R | R | R | R |
| current density A/dm$^2$ | 1 | 1 | 1 | 1 | 2 | 2 |
| plating time min | 10 | 10 | 10 | 10 | 10 | 10 |
| number of A/litre | 0.285 | 0.285 | 0.285 | 0.285 | 0.57 | 0.57 |
| anode - cathode ratio | 3/1 | 3/1 | 3/1 | 3/1 | 3/1 | 3/1 |
| agitation solution (4) | 4A | 4A | 4A | 4A | 4A | 4A |
| agitation cathode (5) | 0 | 0 | 0 | 0 | 0 | 0 |
| cathode (6) | brass | brass | brass | brass | brass | brass |
| anode (7) | PT | PT | PT | PT | PT | PT |
| Plating performance | | | | | | |
| efficiency mg/A.min | 23.7 | 25.4 | 27.8 | 30.2 | 19.6 | 17.1 |
| plating rate mins/ micrometer thickness of deposit | — | — | — | — | — | — |
| macrodistribution % (8) | 43.6 | 56.4 | 56.6 | 59.2(8) | 90.1(8B) | 91.6(8B) |

The bath compositions of the present invention are made up in conventional manner.

The pH of the bath (at 40° C.) is adjusted to about 3.35 to 3.7 electromeric. The final volume is made up with distilled or deionized water and the bath temperature is then controlled to the desired use temperature for the specific example.

During use of the bath the gold metal content should be maintained at the recommended range of about 2.5 to 3.5 g/l by periodic additions of gold potassium cyanide.

The gold will be consumed at a rate of about 100 g per 4500 ampere minutes, working at 2A/dm$^2$, or for every 8330 ampere minute, working at 4A/dm$^2$. A replenisher solution will also be used as is conventional to replace the other ingredients which are consumed during use of the bath When rack plating is being used as in the examples given above the current density is typically about 2–4 A/dm$^2$ preferably 3 with the formulation of Example 2C.

The ratio of the anode area to the cathode area is preferably about 3:1 or 4:1 or higher. The solution density is preferably at least 9° Baume.

What is claimed is:

1. An electroplating bath, comprising a cyanide-containing gold compound wherein the gold is present in an amount of about 2.5 to 3.5 g/l, iron nitrate wherein the iron is present in an amount of about 0.6 to 0.8 g/l, zirconium nitrate wherein the zirconium is present in an amount of about 0.2 to 0.5 g/l, diammonium hydrogen citrate in an amount of about 75 to 125 g/l, citric acid in an amount of about 40 to 80 g/l, and 3-(1-pyridino)-1-propane sulphonate in an amount of about 1 to 3 g/l, wherein the bath is free of cobalt, cadmium and nickel ions.

2. An electroplating bath comprising:

a cyanide-containing gold compound;

an iron compound selected from the group consisting of a soluble salt, a complex, and mixtures thereof;

an ammonium zirconium citrate complex;

a citrate;

a weak acid; and optionally a heterocyclic sulphonate;

wherein the bath is free of cobalt, cadmium, and nickel ions.

* * * * *